United States Patent [19]

Bell et al.

[11] Patent Number: 4,473,114

[45] Date of Patent: Sep. 25, 1984

[54] IN SITU METHOD FOR YIELDING A GAS FROM A SUBSURFACE FORMATION OF HYDROCARBON MATERIAL

[75] Inventors: Christy W. Bell, Berwyn; Charles H. Titus, Newtown Square; John K. Wittle, Chester Springs, all of Pa.

[73] Assignee: Electro-Petroleum, Inc., Wayne, Pa.

[21] Appl. No.: 427,714

[22] Filed: Sep. 29, 1982

Related U.S. Application Data

[63] Continuation-in-part of Ser. No. 242,277, Mar. 10, 1981, Pat. No. 4,382,469.

[51] Int. Cl.[3] ..... E21B 43/24; E21B 36/04

[52] U.S. Cl. ..... 166/248; 166/244 C; 166/279; 166/302; 423/224

[58] Field of Search ..... 166/248, 244 C, 271, 166/265, 302, 308, 279; 48/DIG. 6; 423/224

[56] References Cited

U.S. PATENT DOCUMENTS

| | | | |
|---|---|---|---|
| 849,524 | 4/1907 | Baker | 166/248 |
| 2,795,279 | 6/1957 | Sarapuu | 166/248 |
| 2,818,118 | 12/1957 | Dixon | 166/248 |
| 3,106,244 | 10/1963 | Parker | 166/248 |
| 3,137,347 | 6/1964 | Parker | 166/248 |
| 3,211,220 | 10/1965 | Sarapuu | 166/248 |
| 3,428,125 | 2/1969 | Parker | 166/248 |
| 3,556,716 | 1/1971 | Pollio et al. | 23/2 |
| 3,642,066 | 2/1972 | Gill | 166/248 |
| 3,645,551 | 2/1972 | Thompson | 299/5 |
| 3,696,866 | 10/1972 | Dryden | 166/248 |
| 3,919,390 | 11/1975 | Moore | 423/210.5 |
| 3,941,875 | 3/1976 | Tsuruta et al. | 423/571 |
| 3,962,410 | 6/1976 | Renault et al. | 423/547 R |
| 3,974,256 | 8/1976 | Wheelock et al. | 423/230 |
| 4,084,638 | 4/1978 | Whiting | 166/248 |
| 4,086,323 | 4/1978 | Moore et al. | 423/210.5 |
| 4,207,298 | 6/1980 | Erickson | 423/210.5 |

FOREIGN PATENT DOCUMENTS 756582 9/1956 United Kingdom .

OTHER PUBLICATIONS

Coughlin et al., Nature, vol. 279, pp. 301-303 (1979).

Ray et al., Society of Petroleum Engineers of AIME 7498 (1978).

Garrett et al., Society of Petroleum Engineers of AIME 7499 (1978).

*Primary Examiner*—George A. Suchfield

*Attorney, Agent, or Firm*—Dann, Dorfman, Herrell and Skillman

[57] ABSTRACT

Gas is yielded and may be subsequently withdrawn from a subsurface formation of hydrocarbon material by passing a controlled amount of current from a direct source through the formation. The gas produced by this process has a high quality Btu content and is produced, in situ, under relatively moderate operating conditions. Furthermore, the gas yielded by this method has a reduced amount of hydrogen sulfide present therein.

12 Claims, 1 Drawing Figure

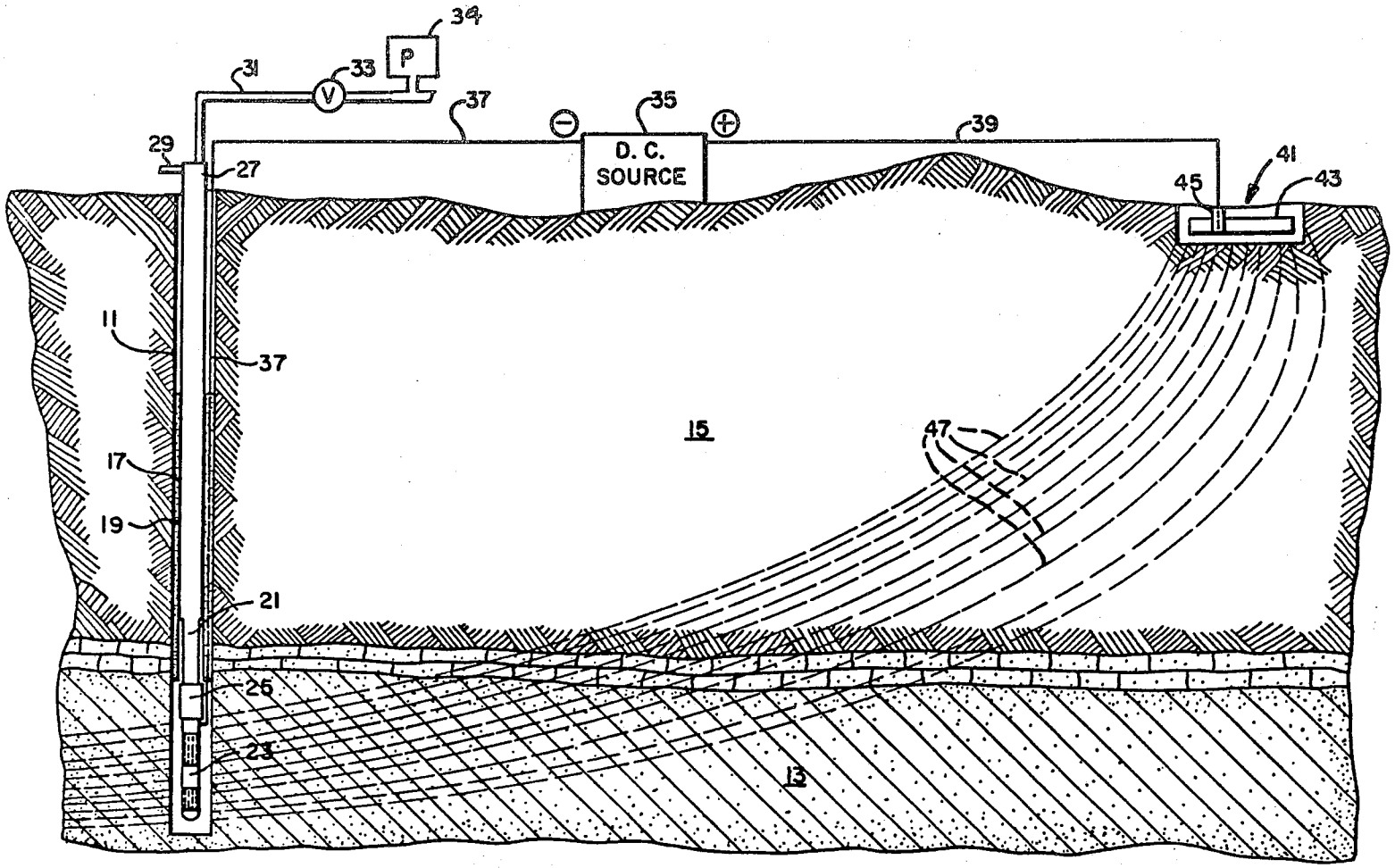
D. C. SOURCE
P
V
11
13
15
17
19
21
23
25
27
29
31
33
34
35
37
37
39
41
43
45
47

IN SITU METHOD FOR YIELDING A GAS FROM A SUBSURFACE FORMATION OF HYDROCARBON MATERIAL

This application is a continuation-in-part of our pending U.S. patent application Ser. No. 242,277 now U.S. Pat. No. 4,382,469 filed on Mar. 10, 1981, entitled "In Situ Gasification".

BACKGROUND OF THE INVENTION

This invention relates to an in situ method for yielding a gas from a subsurface formation of hydrocarbon material. More specifically, the invention relates to the production of high quality Btu fuel gas from subsurface formations of carbonaceous materials and to the reduction of hydrogen sulfide present in the resulting gas, or in natural gas-bearing formations, by applying a controlled current from a direct source to the formation.

The production of gaseous and liquid hydrocarbons by in situ gasification of underground formations of carbonaceous substances, such as coal, oil shale, and the like has long been recognized as a means of avoiding the high costs and inefficiencies attendant fuel production by conventional methods which rely on underground mining operations to provide feed stocks.

Among the prior art methods which have been proposed for in situ gas production are those involving combustion of the carbonaceous material in the subterranean formation. In one such method, a combustion zone is established by depositing combustible material in fractures in the formation adjacent to a well-bore, and passing sufficient current between electrodes positioned in well-bores connected with the fractures so as to heat the combustible material to its ignition temperature. Combustion is supported by the injection of oxygen or air through the well-bore into the combustion zone. As the injection of the combustion-supporting medium continues, the combustion front is driven radially outwardly from the injection well along the fractures. Gaseous hydrocarbons driven out of the formation by the combustion process are recovered from a production well penetrating the formation. See, for example, Dixon, U.S. Pat. No. 2,818,118. Related combustion processes involving electrocarbonization of underground formations to achieve in situ gas production are disclosed in Sarapuu, U.S. Pat. No. 2,795,279 and Parker, U.S. Pat. No. 3,106,244.

Other proposed in situ gasification methods have involved the use of electrical energy to heat the formation directly. For example, Baker, U.S. Pat. No. 849,524, describes a pyrolytic method in which electric current is passed through an underground formation by means of conductors placed in well-bores penetrating the formation, thereby heating the formation and volatizing components thereof, which are recovered through one of the wells. Although the Baker patent does not give the conditions employed in carrying out the method, temperatures in excess of 650° F. are generally necessary to produce fuel gas by pyrolysis of oil shale, tars and coal.

A related method specific to the treatment of oil shale formations is disclosed in Parker, U.S. Pat. No. 3,428,125. The method entails injecting an electrolyte into the formation through two or more well-bores and applying an electrical potential across the formation between the well-bores. An electric current passes through and heats the formation to a temperature sufficient to pyrolyze the hydrocarbons present in the oil shale, while back-pressure is maintained on the formation to prevent vaporization of the electrolyte.

Although the prior art methods referred to above demonstrate that electrical energy can be used successfully for the in situ production of fuel gas, those methods have some rather serious shortcomings.

Combustion processes produce gas which is diluted with combustion products, as well as nitrogen gas in those instances where air is employed to sustain combustion. Dilution occurs as a result of channeling or formation collapse which allows the diluents to break through the combustion front and become intermixed with the gases preceding it. These are natural consequences of combustion processes about which nothing can be done. Hence, while a relatively high Btu content gas is swept in front of the expanding combustion front, the effects of channeling and formation collapse are such that the average Btu value of the gas actually recovered by combustion processes is relatively low, generally on the order of several hundred Btu/cu. ft.

Electrical methods such as those described in Baker, U.S. Pat. No. 849,524 and Parker, U.S. Pat. No. 3,428,125 require that a temperature on the order of 500° F. to 660° F. be maintained in the underground formation for successful operation. The amount of energy required for heating the formation to within this range is substantial. As stated in the Parker patent, for example, an electrical potential in excess of 400 volts must be impressed across the well casings with sufficient back-pressure of up to 1530 psig. applied on the well-bores to maintain the required temperature in the formation. In view of the ever-increasing costs of electrical energy, the operating conditions of these prior art methods must be considered a severe drawback.

A recent article by Coughlin et al, *Nature*, Vol. 279, pp 301–03 (1979) reports on an improved electrical method for coal gasification. In this method, a coal slurry undergoes treatment in an electrochemical cell, which is divided into separate anode and cathode compartments, to produce essentially pure hydrogen at the cathode, and $CO_2$, containing small amounts of CO (about 3% at steady-state) at the anode. The method is carried out at relatively moderate temperatures and electrical potentials. For example, lignite reportedly has been gasified at potentials from 0.85 to 1.0 volts at about 240° F. While this method has been practiced on a laboratory scale, its commercial practicability has yet to be demonstrated. Moreover, even if operative on a commercial scale, the operating cost of such a method would be relatively high, since mined coal would be required for the feed stock. Further, the mixture of gases produced by this method has a lower Btu value than is acceptable for a fuel gas.

Treatment of sour gas, that is, gas having a relatively high concentration of hydrogen sulfide, usually takes place after the gas has been produced. The removal of hydrogen sulfide is of primary importance to refiners because, not only is hydrogen sulfide a catalyst poison for downstream processing, but environmental considerations dictate the removal of sulfur-containing components from fuel gases.

Among the prior art methods which have been proposed for removing hydrogen sulfide from gas streams and gas wells are those involving scrubbing sour gas at elevated temperatures with a regenerable sorbent. See, for example, Wheelock et al, U.S. Pat. No. 3,974,265. Related scrubbing processes are disclosed in Erickson, U.S. Pat. No. 4,207,298 and Moore, U.S. Pat. Nos. 4,086,323 and 3,919,390.

Other proposed methods involve scrubbing the gas streams with liquid solutions such as mixtures of ethanolamines or mixtures comprising anthraquinone disulfonic acids at a temperature of about 200° to 300° F. These processes typically incorporate some regenerable compound which also acts as an oxidant, oxidizing the hydrogen sulfide to sulfur.

These prior art processes for hydrogen sulfide removal have been limited in either application or efficiency for one reason or another. In particular, all the above processes are applied after the gas has been produced.

Other processes which have been reported for the scrubbing of hydrogen sulfide from sour gas prior to production have been applied in the wellbore during drilling by additions of reactants to the drilling mud. Ray et al. in an article entitled "Use of Reactive Iron Oxide to Remove Hydrogen Sulfide From Drilling Fluid" (Society of Petroleum Engineers of AIME SPE 7498 (1978)), report the use of iron oxide added to drilling mud to react with the hydrogen sulfide.

Garret et al in an article entitled "Chemicals Scavangers For Sulfides In Water Base Drilling Fluids" (Society of Petroleum Engineers of AIME SPE 7499 (1978)), also report the use of chemical scavangers for sulfides in water base drilling fluids.

SUMMARY OF THE INVENTION

In accordance with the present invention, it has now been discovered that a gas is yielded under reasonably moderate operating conditions from a subsurface formation of hydrocarbon material. The method involves providing an aqueous electrolyte in contact with said hydrocarbon material, placing at least two electrically conductive elements, constituting an anode and a cathode, in contact with the electrolyte, and passing a controlled amount of electric current from a direct source through the formation between the electrically conductive element at a voltage of at least 0.3 volts and controlling the current relative to the composition of said material and the ambient conditions adjacent to said electrode to heat the surface of the electrodes during application of the voltage to a temperature which is less than 500° F., and withdrawing from the formation the gas resulting from the treatment.

In accordance with one aspect of the present invention, it has been discovered that large quantities of high quality Btu fuel gas may be produced in situ under reasonably moderate operating conditions from an underground formation or deposit of carbonaceous material. The gas produced by this method generally has a Btu content of 300 or higher. The method involves providing an aqueous electrolyte in contact with the carbonaceous material placing at least two electrically conductive elements, constituting an anode and a cathode, in contact with the electrolyte, and passing a controlled amount of electric current from a direct current source through the formation between the electrically conductive elements at a voltage of at least 0.3 volts and controlling the current relative to the composition of said material and the ambient conditions adjacent to said electrode to heat the surface of the electrodes during application of the voltage to a temperature which is less than 500° F., thereby producing gas by electrochemical action within the formation and the accompanying gasification of said carbonaceous material. The expression "electro-chemical action" is used herein in a broad sense to signify electrolysis of the electrolyte, changes in the characteristics of the carbonaceous material by the passage of direct electrical current therethrough, and/or oxidation of the carbonaceous material.

In accordance with another aspect of the present invention, it has been discovered that hydrogen sulfide may be removed in situ under reasonably moderate operating conditions from gas produced by gasification processes, such as that just described, and from natural subsurface formations of gas. In the process, hydrogen sulfide is removed in situ, by passing a controlled amount of electric current from a direct source through a gas-containing formation whereby any hydrogen sulfide present in a gas is oxidized at anodic sites. A second mechanism which is believed to effect removal of hydrogen sulfide according to the present invention is neutralization with basic substances formed at cathodic sites, which react with the hydrogen sulfide to form ionic sulfur and water.

This gas sweetening aspect of the present invention has a wider scope of application than the aforementioned in situ gasification process in that it may be used to treat any sour gas stream containing hydrogen sulfide, whether produced in situ or naturally occuring in the formation.

From this brief description, it will be appreciated that the present invention provides a process for the production of a high Btu content fuel gas which obviates underground mining or production operations.

In addition, the present invention provides a process for the in situ production of fuel gas from an underground formation, which gas is of a substantially higher quality than that produced by processes involving combustion in the formation.

The present invention further provides an electrical process for the in situ production of a fuel gas under relatively moderate temperatures and electrical power input.

The present invention also provides a process for the in situ production of a high Btu content gas on a commercial scale.

Finally, the present invention provides a process for in situ sweetening of sour gas streams and sour gas wells.

A notable advantage of the present invention over prior art process involving electrical treatment of subsurface formation is that it produces high Btu fuel gas having significantly reduced hydrogen sulfide levels under relatively moderate operating conditions. Moreover, the process of the present invention produces satisfactory results in areas where existing recovery technology has been ineffective.

DESCRIPTION OF THE INVENTION

The in situ gasification aspect of the present invention will be fully understood from a reading of the following detailed description thereof, in conjunction with the accompanying drawing in which the sole FIGURE is a cross-sectional view through an underground formation or deposit of carbonaceous material penetrated by a single well-bore, with apparatus for the practice of the present method shown schematically therein.

Referring more specifically to the drawing, there is shown a well-bore 11 which extends from the earth's surface and penetrates a subterranean formation of carbonaceous material 13 lying beneath overburden 15.

The subterranean formations from which gas may be produced in accordance with this invention include deposits of heavy oil, coal, or oil shale.

The well-bore 11 is provided with a pressure resistant casing 17 which desirably extends from the surface at least to the top of the formation, and which may be cemented in the well-bore as indicated by reference numeral 19. The well casing may be fabricated of electrically insulating or electrically conductive material. The electrically conductive casing may be wrapped with insulation tape or other similar material to provide an insulating layer or sheath on the outside thereof, or may be articulated by one or more insulated segments. The lower end of the casing may be provided with a horizontally disposed annular plate or sealing diaphragm (not shown).

The well is also provided with a hollow, metal well liner 21, which is hung from the well casing and extends to any desired depth in the well bore 11. Attached to the bottom end of the well liner is an electrically conductive element 23, which serves as a "down hole" electrode. The conductive element 23 must possess low electrical resistivity and exhibits sufficient mechanical strength, thermal stability and resistance to corrosion to prevent breakdown during normal operation of the process. The electrically conductive element is electrically isolated from the well liner by an insulating sleeve 25. A section of fiber glass pipe or equivalent material provides a satisfactory insulating sleeve. Electrically conductive element 23 may have perforations on the external surface thereof, as shown in the drawing, and/or the lower end thereof may be open for the injection of fluids into, or the withdrawal of fluids from, the well-bore. In this connection, the well head 27 is provided with an input flow line 29 for the delivery of fluids to the well bore. Thus, fluids may be injected into the well under pressure through flow line 29 and discharged through the opening(s) in electrically conductive element 23 whereupon they seep into the surrounding formation between the bottom of the casing and the bottom of the well-bore. Gas produced in the formation is extracted through flow line 31, which may have a control valve 33 and conventional pumping means 34 connected therewith.

At surface level, one terminal of a direct current source, shown schematically as 35, is connected to electrically conductive element 23 via cable 37. The other terminal of direct current source 35 is connected via cable 39 to electrode 41 located adjacent the earth's surface. The direct current source may be powered from an A.C. power system of the type used in oil production fields. The operating electrical current should be selected so as to maintain a temperature of less than 500° F. within the formation at the surface of the electrodes. Generally, this may be accomplished by connecting the electrodes to a controlled direct current source and passing a current through the formation at a voltage range sufficient to establish the desired temperature and electro-chemical activity.

As illustrated in the drawing, the negative terminal of the direct current source is connected to the "down hole" electrode, making it the cathode, and the positive terminal of the direct source is connected to the surface-level electrode, making it the anode. Although the drawing shows one "down hole" electrode and one surface level electrode, the process will operate satisfactorily with two or more "down hole" electrodes. The surface-level electrode simplifies operation of the process by obviating the need for a second well bore.

The direct current source 35 is provided with a current regulator for controlling the current applied to the electrodes. Suitable transformers, switches, meters, or other electrical instruments are also employed for regulating the direct current supply and the electrical treatment of the formation so as to optimize gas production. Other instruments, well known to those skilled in the art may be included for monitoring conditions in the formation, analyzing the gaseous product, or otherwise providing desired information concerning the operation of the process.

Satisfactory results have been obtained using a multi-element electrode. In this case, the surface-level electrode 41 comprises a plurality of electrically conductive pipes 43 (only one shown in drawing) arranged parallel to one another in a horizontal plane in a containment means in the earth's surface. Each electrically conductive pipe of the surface-level electrode is attached to an electrical contact 45 which is connected in turn to direct current source 35. Other forms of surface-level electrodes such as those described in Sarapuu, U.S. Pat. No. 3,211,220 may be used in the practice of this invention.

A current path, represented in the drawing by dashed lines 47, is established between the two electrodes described above by providing an aqueous electrolyte in contact with the formation. In most instances, connate water within an underground formation of carbonaceous material will contain various dissolved salts, thereby providing a natural aqueous electrolyte solution. Where the formation tends to be dry, as in the case of oil shale, for example, a suitable electrolyte solution must be injected from above ground through the well liner and into the formation. Where necessary, an electrolyte solution may be injected into the earth in the vicinity of the surface-level electrode.

The embodiment of this invention illustrated in the drawing and described in the preceding paragraphs establishes an electrical circuit for current flow, which travels from direct current source 35, through cable 39, passing through the formation between surface level electrode 41, and "down hole" electrode 23 via the electrolyte, and back to the direct current source through cable 37.

For maximum operating efficiency, the "down hole" electrode should be shorter than the thickness of the formation undergoing treatment. This tends to confine the current flow to a reasonably narrow band within the formation, heating the formation rather than the overburden or underburden. The thickness, as well as other characteristics of the formation may be determined rather accurately by methods well known to those skilled in the art, such as electric logging, core sampling, and the like.

In order to optimize gas production in formations having low gas permeability and diffusiveness, the formation may be provided with passageways prior to commencing electrical treatment, so that the gas is permitted to permeate through the formation and reach the well-bore through which it is withdrawn from the formation. This may be achieved by conventional fracturing techniques. Other procedures for rendering the formation permeable to fluid flow, which are well known to those skilled in the art, may also be employed if the formation is not sufficiently permeable.

Under normal operating conditions, the temperature rise around the "down hole" electrode is generally higher than in the formation because the current and voltage densities are concentrated in this vicinity. Accordingly, this region may be kept cool by introducing a liquid coolant into the well-bore. The liquid coolant may be continually recirculated by pumping it back to the surface after injection into the well-bore. Alternatively, the liquid coolant may be injected through openings in the "down hole" electrode into the formation, to simultaneously cool the electrode and carry heat into the formation. In both of these procedures the back pressure imposed on the well-bore controls the boiling point of the electrolyte and prevents large heat losses during operation of the process. These cooling procedures have been employed in maintaining the temperature at the surface of the "down hole" electrode below 275° F. for up to 5440 hours of operation of the process.

The preferred liquid coolant for use in connection with this invention is water. Although other liquid coolants are available, including a variety of hydrocarbon liquids, water is preferable to such other coolants from the standpoint of cost and availability. When the coolant liquid is injected into the formation, brine may be used, in whole or in part. In addition to cooling the "down hole" electrode, brine will replenish electrolyte which may have been lost through evaporation.

High quality gas was produced using the above described process in tests conducted in a heavy oil (tar sand) formation in the Brooks Zone near Santa Maria, Calif. The Btu content of the gas produced was consistently in excess of 1000, and was calculated to be approximately 150% of the input energy. This represents about a 44.5% increase over the Btu content of the gas naturally occurring in the formation. The average temperature at the "down hole" electrode surface during operation of the process was 255° F. The two electrodes were spaced approximately 3000 feet apart. Gas samples were taken for analysis by gas chromatography and were found to consist essentially of hydrogen, hydrocarbons from 1 to 8 carbon atoms and carbon monoxide, which is a readily combustible mixture.

Although the electrochemical mechanism by which gas is produced by the above-described method is not completely understood, it is believed to result from the combined action of electrolysis of the electrolyte and gasification of the carbonaceous material in the formation, as previously mentioned. Electro-chemical action within the formation produces hydrogen along with carbon monoxide; gasification produces the $C_1$ to $C_8$ hydrocarbon gases.

The amount of hydrogen produced by this process has been calculated as being in excess of that which would be anticipated assuming that water in the formation undergoes electrolysis at 100% efficiency at the cathode. Thus if all of the electrical input to the formation during this period were used at 100% efficiency in the production of hydrogen by electrolysis, the theoretical amount of hydrogen produced should have been only 45% of the amount of hydrogen actually recovered.

The production of excess hydrogen gas may be explained, at least in part, as resulting from the occurrence of electrolysis remote from the electrodes but within the electrical field in the formation. It is thought that electrolysis occurs at other anodic and cathodic sites, such as at the end of shale stringers or other natural discontinuities in the formation where sufficient electrical potential is available. The production of hydrogen at a multiplicity of sites throughout the formation is possible only as a result of conditions created by the passage of direct electrical current through the formation.

It is also conceivable that a hydrocarbon cracking mechanism may contribute to the production of hydrogen in this process.

In contrast to the gas recovered prior to the testing period, the $C_2$ to $C_6$ fraction of the gas produced during the testing period increased by 500% to 600%; however, the methane content decreased by about 50%. This increase in the $C_2$ to $C_6$ fraction is primarily responsible for the high quality of the gas produced by the process of this invention. Thus, whatever the mechanism at work, it produces an unexpected increase in the hydrocarbon component of the recovered gas.

The carbon dioxide content of the gas produced during the test period was generally lower than that of the gas naturally occuring in the formation prior to the test period. During periods when the DC power was interrupted, the $CO_2$ content was about 50% of the original amount, whereas during application of D.C. power, the carbon dioxide content decreased to 25% of the original amount. The reduction in carbon dioxide content is attributed to the increase in pH of the electrolyte from 7 or 8 to 10 or higher during application of power.

Although there is some suggestion of the use of direct current potential for in situ gasification in the prior art, the practitioners of the prior art methods apparently did not appreciate the distinct advantages attendant the use of a controlled direct current, both as to the increase in the quality of gas produced, and the reduction in the cost of operating the process by reason of the comparatively lower temperature and electrical potentials which may be employed. Application of a direct current through the formation has other advantages over the use of an alternating current potential. For example, when alternating current is passed by means of a cable or insulated tubing string down a well-bore having a steel casing, the well casing behaves like a very inefficient transformer core, wasting much of the electrical energy by heating the casing and the overburden rather than the formation. In addition to being more efficient, the use of a direct current source may require only 5% to 10% of the voltage that an alternating current source would require in order to pass the same magnitude of current into a formation. This improves safety and reduces the difficulty and expense involved in providing down hole electrical insulation.

The preference for alternating current systems over direct current systems in the prior art may have been due to concern over electrolytic corrosion of the piping employed, particularly the anode. Such concern is unwarranted, however, for experience with the present process has demonstrated that corrosion of the anode can be easily controlled by using an anode design of the multi-element electrode type described above. Alternatively, corrosion-resistant materials, such as lead dioxide or graphite may be used in fashioning the anode. Corrosion of the cathode simply does not occur to an appreciable degree in the practice of this invention.

The use of a controlled current source is preferable to a constant voltage source since the latter is potentially unstable and may cause "runaway" temperatures at the well-bore in situations where, as in the practice of this invention, the resistance of the formation decreases with increasing temperature. Indeed, in the present invention, the decrease in formation resistivity with increasing temperature acts as a temperature regulator in the vicinity of the well-bore and further aids in moving the heat further out into the formation.

As previously mentioned, in situ gasification according to the present invention may be employed successfully in producing fuel gas from heavy oil, oil shale or coal formations. The expression "heavy oil" as used herein is intended to encompass deposits of carbonaceous material which are generally regarded as exhausted because treatment by presently available recovery processses are uneconomical or impractical. These include, for example, tar sands, and oil residues in wells that have been depleted by primary, secondary and tertiary recovery processes. In the case of coal formations, this process is particularly suited for the recovery of gas from coal located at depths too great for conventional mining operations, or from deposits of inferior value.

Although a specific well completion procedure is described above, it should be understood that other completion procedures well known to those skilled in the art and consistent with the practice of this invention may also be employed.

As indicated above, the present invention further provides a process for the in situ removal of hydrogen sulfide from gas derived from a subsurface formation by passing a controlled direct electric current through the gas-bearing formation between a pair of electrodes which penetrate the formation. This process is also known as in situ sweetening of sour gas streams and sour gas wells.

The passage of DC controlled current through a gas containing formation effectively removes hydrogen sulfide in situ. Any hydrogen sulfide present in the gas will be oxidized at anodic sites both at the anodic electrode and at natural discontinuities in the formation that become charged during the process. The hydrogen sulfide may also be neutrualized by basic substances formed at cathodic sites which react with hydrogen sulfide to form water and sulfur.

Oxidization of hydrogen sulfide occurs preferentially, since other possible competing reactions which may take place at the same sites require higher voltage potentials than those necessary to oxidize hydrogen sulfide to sulfur. The redox potentials for other materials which may be found in connate water, and which could interfere with the desired hydrogen sulfide oxidation are given in Table 1. These redox potentials were taken from Latimer "Oxidization Potentials", Prentice-Hall, Inc., and were determined at S.T.P. The actual potentials may be lower depending on temperature and pressure.

TABLE 1

| | |
|---|---|
| $2H_2O = O_2 + 4H^+ 4e^-$ | $E = -1.229$ |
| $4OH^- = O_2 + 2H_2O + 4e^-$ | $E_B = -0.401$ |
| $2Cl^- = Cl_2 + 2e^-$ | $E^o = -1.3595$ |
| $2Br^- = Br_2 + 2e^-$ | $E^o = -1.087$ |
| $2I^- = I_2 + 2e^-$ | $E^o = -0.5355$ |
| $H_2S = S + 2H^+ 2e$ | $E^o = 0.141$ |

Neutralization of hydrogen sulfide is believed to occur at the cathodic site by way of a two-step rection. The first reaction is as follows:

$$2H_2O+2e^- \; H_2+2OH^-.$$

The base thus formed reacts with hydrogen sulfide in the second reaction to form ionic sulfur and water, as follows:

$$H_2S+2OH^- \; 2H_2O+S^{--}.$$

It is believed that the ionic sulfur thus formed either reacts with cations present to form an insoluble sulfide precipitate and/or remains in soluble form in the connate water present within the underground formation.

In field applications a substantial reduction of hydrogen sulfide levels was observed in gas produced by a D.C. current in accordance with the present invention, as compared with the gas naturally occurring in the formation. This observation was based on the results of analysis of gas samples taken periodically over a period of approximately three months from a cathode well (Well #1) and at nearby non-electrically active well (Well #2) as indicated in Table II.

TABLE II

| | $H_2S$ Content of Gas | |
|---|---|---|
| Sample No. | Well #1 (ppm) | Well #2 (ppm) |
| 1 | 20 | 2290. |
| 2 | 9.9 | 2510. |
| 3 | 2.8 | — |
| 4 | .4 | 154. |
| 5 | 1.3 | — |
| 6 | 2.16 | — |
| 7 | 3.2 | — |
| 8 | — | 33.9 |

The above results indicate that Well #2, though not serving as an electrode, was located within an area in which anodic sites were set up. In addition, the observation that the hydrogen sulfide level initially dropped more rapidly in Well #1 than in Well #2 may be accounted for because any hydrogen sulfide which reached the well bore of Well #1 was scrubbed (neutralized) by the base formed at the cathode surface.

The process just described for in situ removal of hydrogen sulfide has broader applicability than the in situ gasification process inasmuch as it may be practiced on naturally occurring subsurface formations of gas as well as underground formations or deposits of carbonaceous materials.

It should be understood that the description of this invention set forth in the foregoing specification is intended merely to illustrate and not to limit the invention. Those skilled in the art will appreciate that the implementation of the above-described process is capable of wide variation and modification without departing from the scope and spirit of the invention as set forth in the appended claims.

What is claimed is:

1. A process for the in situ reduction of the hydrogen sulfide concentration of a gas derived from a subsurface formation, which method comprises providing an aqueous electrolyte in contact with said formation, providing at least two electrically conductive elements, constituting an anode and a cathode, in contact with said electrolyte, passing a controlled amount of electrical current from a direct current source through said formation between said electrically conductive elements at a voltage of at least 0.3 volts and controlling the current relative to the composition of said material and the ambient conditions adjacent to said electrode to heat the surface of the electrodes during application of said voltage to a temperature which is less than 500° F. thereby to yield a gas which has a hydrogen sulfide content substantially less than the gas naturally occurring in the formation.

2. The process of claim 1 wherein the subsurface formation is a formation of carbonaceous material.

3. The process of claim 1 wherein the subsurface formation is a gas bearing formation.

4. The process of claim 1 wherein the hydrogen sulfide containing-gas produced is a combustible gas consisting essentially of hydrogen, hydrocarbons having from 1 to 8 carbon atoms, and carbon monoxide.

5. The process of claim 1 wherein one of said electrically conductive elements is provided adjacent the earth's surface.

6. The process of claim 5 wherein the electrically conductive element provided adjacent the earth's surface serves as the anode.

7. The process of claim 1 wherein at least one of said electrically conductive elements is provided by drilling a well which penetrates said formation and inserting in the well bore an elongated liner having an upper portion and electrically conductive lower portion, said upper portion being electrically insulated from said lower portion, which latter portion is connected to said direct current source.

8. The process of claim 7 wherein said lower portion of said liner serves as the cathode.

9. The process of claim 7 wherein the formation has a given thickness and said lower portion of said liner is disposed within the boundary of said formation and is shorter than the thickness of said formation.

10. The process of claim 7 which includes cooling the formation around the electrically conductive lower portion of said liner by introducing a liquid coolant into the well-bore.

11. The process of claim 10 wherein the electrically conductive lower portion of said liner is perforated and said liquid coolant is injected into said formation through said lower portion.

12. The process of claims 10 or 11 wherein said liquid coolant is water.

* * * * *